US006022175A

United States Patent [19]

Heinrich et al.

[11] Patent Number: 6,022,175

[45] **Date of Patent: *Feb. 8, 2000**

[54] ELONGATE ROTARY TOOL COMPRISING A CERMET HAVING A CO-NI-FE BINDER

[75] Inventors: Hans-Wilm Heinrich; Manfred Wolf; Dieter Schmidt, all of Bayreuth, Germany; Uwe Schleinkofer, Latrobe, Pa.

[73] Assignee: Kennametal Inc., Latrobe, Pa.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/921,996

[22] Filed: Aug. 27, 1997

[51] Int. Cl.[7] ..... B23B 27/14

[52] U.S. Cl. ..... 407/119; 407/118; 407/120; 408/144

[58] Field of Search ..... 407/119, 120, 407/118; 408/144, 145; 175/428, 432; 75/230, 242; 76/108.1, 108.6; 428/560, 562

[56] References Cited

U.S. PATENT DOCUMENTS

| | | | |
|---|---|---|---|
| Re. 30,807 | 12/1981 | Elders | 299/86 |
| Re. 34,180 | 2/1993 | Nemeth et al. | 428/547 |
| 2,162,574 | 6/1939 | Dawihl et al. | 75/136 |
| 2,202,821 | 6/1940 | Balke | 75/136 |
| 3,514,271 | 5/1970 | Yates | 29/182.5 |
| 3,816,081 | 6/1974 | Hale . | |
| 4,049,380 | 9/1977 | Yih et al. | 428/539.5 |
| 4,083,605 | 4/1978 | College et al. | 299/91 |
| 4,556,424 | 12/1985 | Viswanadham | 75/240 |
| 4,593,776 | 6/1986 | Salesky et al. | 175/375 |
| 4,642,003 | 2/1987 | Yoshimura | 408/144 |
| 4,743,515 | 5/1988 | Fisher et al. | 428/698 |
| 4,869,329 | 9/1989 | Kar et al. | 175/57 |
| 4,907,665 | 3/1990 | Kar et al. | 175/410 |
| 4,971,485 | 11/1990 | Nomura et al. | 408/144 |

(List continued on next page.)

FOREIGN PATENT DOCUMENTS

| | | |
|---|---|---|
| 1543214 | 10/1968 | France . |
| 29617040 | 3/1997 | Germany . |
| 46-15204 | 4/1971 | Japan . |
| 50-110909 | 9/1975 | Japan . |
| 53-21016 | 2/1978 | Japan . |
| 5429900 | 3/1979 | Japan . |
| 61194147 | 8/1986 | Japan . |
| 2273301 | 6/1994 | United Kingdom . |
| WO9621052 | 7/1996 | WIPO . |
| 9721844 | 6/1997 | WIPO . |

OTHER PUBLICATIONS

Translation of Cobalt Replacement In Technical Hard Metals, H. Grewe et al.; PTO 99–2840, Translated Apr. 1999.

L. J. Prakash et al.: "The Influence of the Binder Composition on the Properties of WC–Fe/Co/Ni Cemented Carbides," Mod. Dev. Powder Metal, vol. 14, 1981, XP002085832.

Chemical Abstracts, vol. 121, No. 22, Nov. 1994, Abstract No. 261210. (J. M. Guilemany et al.: "Mechanical–Property Relationships of Co/WC and Co–Ni–Fe/WC Hard Metal Alloys," Int. J. Refractory Metals & Hard Materials, (1994), 12(4), 199–206).

B. Uhrenius et al.: "On the Composition of Fe–Ni–C0–WC–based Cemented Carbides," vol. 15, 1997, pp. 139–149, XP002085833.

(List continued on next page.)

*Primary Examiner*—Andrea L. Pitts
*Assistant Examiner*—Henry W. H. Tsai
*Attorney, Agent, or Firm*—John J. Prizzi

[57] ABSTRACT

An elongate rotary tool including at least one cutting edge that is useful in the machining of workpiece materials is disclosed. The elongate rotary tool comprises a cermet comprising at least one hard component and about 0.2 wt. % to 19 wt. % Co—Ni—Fe-binder. The Co—Ni—Fe-binder is unique in that even when subjected to plastic deformation, the binder substantially maintains its face centered cubic (fcc) crystal structure and avoids stress and/or strain induced transformations.

70 Claims, 1 Drawing Sheet

U.S. PATENT DOCUMENTS

| | | | |
|---|---|---|---|
| 5,066,553 | 11/1991 | Yoshimura et al. | 407/119 X |
| 5,186,739 | 2/1993 | Isobe et al. | 408/144 X |
| 5,541,006 | 7/1996 | Conley | 428/552 |
| 5,658,395 | 8/1997 | Wahlberg et al. | 148/237 |
| 5,697,042 | 12/1997 | Massa et al. | 419/10 |
| 5,716,170 | 2/1998 | Kammermeier et al. | 408/145 |
| 5,766,742 | 6/1998 | Nakamura et al. | 407/119 X |
| 5,776,588 | 7/1998 | Moriguchi et al. | 407/119 X |
| 5,776,593 | 7/1998 | Massa et al. | 428/212 |
| 5,806,934 | 9/1998 | Massa et al. | 299/111 |
| 5,821,441 | 10/1998 | Kawamura | 75/248 |

OTHER PUBLICATIONS

H. Grewe et al.: "Substitution of Cobalt in Cemented Carbides," Metall (Berlin) (1986), 40(2), 133–40, XP002086162.

Chemical Abstracts, vol. 126, No. 9, Mar. 1997, Abstract No. 121055. (Yoshihiro Minato et al.: "Tungsten Carbide–Based Hard Alloys Having High Impact Resistance for Tools," JP 08 302441 A (Sumitomo Electric Industries, Japan)).

Chemical Abstracts, vol. 114, No. 6, Feb. 1991, Abstract No. 47911. (Noribumi Kikichi et al.: "Manufacture of Surface–Coated Tungsten Carbide–Based Cermets for Cutting Tools," JP02 022454 (Mitsubishi Metal Corp., Japan)).

Chemical Abstracts, vol. 108, No. 12, Mar. 1988, Abstract No. 99568. (Sokichi Taktau et al.: "Alumina–Coated (Mitsubishi Metal Corp., Japan) Sintered Alloys for Cutting Tools," JP 62 047123 (Toshiba Tungaloy Co., LTD, Japan)).

Copies of International Search Reports mailed Dec. 14, 1998, in Application Nos. PCT/IB98/01297, PCT/IB98/01298, PCT/IB98/01299, PCT/IB98/01300, and PCT/IB98/01301, all Filed Aug. 20, 1998.

Thakur, Dr. Babu N., "The Role of Metal Powders in Manufacturing Diamond Tools," SME Technical Paper, MR85–307, Superabrasives '85 Conference, Apr. 22–25, 1985, Chicago, pp. Title Page–17.

Kennametal Inc., Latrobe, PA, "Hot–Press Diamond Matrix Powders," Publication No. ML86–1(2.5)C6, 1986, pp. Title Page–31.

Kennametal Inc., Latrobe, PA, "Infiltration Diamond Matrix Powders," Publication No. ML86–4(3)G6, 1986, Title Page–27.

Macro Division of Kennametal Inc., Port Coquitlam, B.C., Canada, "Cobamet Alloy Powders ," Publication No. CT6086–2, 1986, one page.

Macro Division of Kennametal Inc., Port Coquitlam, B.C., Canada, "Cobamet Alloys," Publication No. AM89–10, 1989, one page.

Table I, entitled "Cobamet Alloy Powder," one page.

Thümmler, F., et al, "Ergebnisse Zur Weiterentwicklung Von Hartstoffen Und Hartmetallen," Proc. Plansee–Semin., 10th (1981), vol. 1, pp. 459–476, Metallwork Plansee GmbH, Reutte, Austria. (English Translation).

Holleck, H., et al., 1977 Annual Report, Aufbau, Herstellung, und Eigenschaften hochschmelzender Verbindungen and Systeme (Harstoffe und Hartmetalle), KfK–Ext. 6/78–1, Institute for Materials and Solid State Research, Kernforschungszentrum in Karlsruhe, Germany, pp. 57–65 including English translation of Oberacker, R., et al., "Properties of Tungsten Carbide Hard Metals with Fe–Co–Ni Binder Alloys, Part I: Effect of the Composition, including Carbon Content," pp. 57–65.

Holleck, H., et al., 1977 Annual Report, Aufbau, Herstellung, und Eigenschaften hochschmelzender Verbindungen and Systeme (Harstoffe und Hartmetalle), KfK–Ext. 6/78–1, Institute for Materials and Solid State Research, Kernforschungszentrum in Karlsruhe, Germany, pp. 66–77 including English translation of Prakash, L., "Properties of Tungsten Carbide Hard Metals with Fe—Co—Ni Binder Alloys, Part II: Effect of Heat Treatment," pp. 66–77.

Holleck, H., et al., 1977 Annual Report, Aufbau, Herstellung, und Eigenschaften hochschmelzender Verbindungen and Systeme (Harstoffe und Hartmetalle), KfK–Ext. 6/78–1, Institute for Materials and Solid State Research, Kernforschungszentrum in Karlsruhe, Germany, pp. 78–86 including English translation of Oberacker, R., et al., "Wettability of Tungsten Carbine By Fe–Co–Ni Binder Alloys," pp. 78–86.

Yin Zhimin et al., "Microstructure and Properties of WC–10 (Fe,Co,Ni) Cemented Carbides," J. Cent.–South Inst. Min. Metall., vol. 25, No. 6, Dec. 1994, pp. 719–722. (English Translation).

Raynor, G. V., et al., "Phase Equilibria in Iron Ternary Alloys, A Critical Assessment of the Experimental Literature," The Institute of Metals, 1988, pp. 247–255.

"Binary Alloy Phase Diagrams," Second Edition, vol. 1.0 ed., Ed. Massalski, T. B. et al, pp. 136–138, 269–270, 355–356, 471–472, 571, 725–727, 835–836, 902–905.

Roebuck, B., et al., "Miniaturised thermomechanical tests on hardmetals and cermets" in ed., Sarin, V., "Science of Hard Materials—5," Proceedings of the 5$^{th}$ International Conference on the Science of Hard Materials, Maui, Hawaii, Feb. 20–24, 1995, Materials Science and Engineering, Elsevier Publishing Company, vol. A209, Nos. 1–2, pp. 358–365.

Suzuki, H., et al, "Effects of Surface–Grinding on Mechanical Properties of WC—Co Alloy", Journal of the Japan Institute of Metals (1974), vol. 38, No. 7, pp. 604–608 (Japanese Language with some English Translation).

Suzuki, H., et al, "Room–Temperature Transverse–Rupture Strength of WC–10% Ni Cemented Carbide", J. Japan Inst. Met. 41 (6), Jun. 1977, pp. 559–563(Japanese Language with some English Translation).

Suzuki, H., et al, Properties of WC–10% (Ni–Fe) Alloys, Department of Metallurgy, Faculty of Engineering, University of Tokyo, Tokyo, pp. 26–31 (Japanese Language with some English Translation).

"Standard Test Method for Flexural Strength of Advanced Ceramics at Ambient Temperature," (Designation: C 1161–90) reprinted from Annual Book of ASTM Standards, American Society for Testing and Materials, Philadelphia, PA.

Prakash, L., et al, "Properties of Tungsten Carbides with Iron–Cobalt–Nickel Alloys as Binders," Sixth International Powder Metallurgy Conference, Dresden, German Democratic Republic, 1977, pp. 39–1–39–16, preprint (German and English Translation).

Thümmler, F., et al, "Ergebnisse Zur Weiterentwicklung Von Hartstoffen Und Hartmetallen," (German Language), Proc. Plansee–Semin., 10th (1981), vol. 1, pp. 459–476, Metallwork Plansee GmbH, Reutte, Austria.

Penrice, T., "Alternative Binders for Hard Metals," J. Materials Shaping Technology, vol. 5, No. 1, 1987, pp. 35–39, 1987 Springer–Verlag New York Inc.

Farooq, T. et al., "73 A Study of Alternative Matrices for WC Hardmetals," PM 1990's Int. Conf. Powder Metall. (1990), Issue 2, 388–94, Inst. Met., London, U.K., pp. 388–394.

Holleck, H., et al., 1977 Annual Report, Aufbau, Herstellung, und Eigenschaften hochschmelzender Verbindungen and Systeme (Harstoffe und Hartmetalle), KfK–Ext. 6/78–1, Institute for Materials and Solid State Research, Kernforschungszentrum in Karlsruhe, Germany, pp. 1–140 (pp. 87–94).

"Binary Alloy Phase Diagrams," Second Edition, vol. 2.0 ed., Ed. Massalski, T. B. et al, pp. 971, 1047–50 & 1179–1265, ASM International.

Guillermet, A. F., "The Co–Fe–Ni–W–C Phase Diagram: A Thermodynamic Description and Calculated Sections for (Co–Fe–Ni) Bonded Cemented WC Tools," Z. Metallkd. (1989), 80(2), pp. 83–94.

Crook, P., "Cobalt and Cobalt Alloys," Metals Handbook, Tenth Edition, vol. 2 Properties and Selection: Nonferrous Alloys and Special–Purpose Materials (1990), pp. 446–454, ASM International.

Betteridge, W., "Cobalt and Its Alloys," Ellis Horwood Ltd., Halsted Press: a division of John Wiley & Sons, New York, 1982, pp. 41–59.

"Cobalt Facts," Section 10, Cobalt Supply & Demand 1995, pp. 105–112, The Cobalt Development Institute, Essex, U.K.

"Cobalt Monograph," 1960, pp. 170–240. Ed. Centre D'Information du Cobalt, Brussels, Belgium.

Holleck, H. et al., "Constitution of Cemented Carbide Systems," Int. J. Refract. Hard Met. 1, (3), pp. 112–116 (Sep. 1982).

Brabyn, S. M. et al., "Effects of the Substitution of Nickel for Cobalt in WC Based Hardmetal," Proceedings of the 10$^{th}$ Plansee—Seminar 1981 (Metalwork Plansee, Reutte, Austria, Jun. 1–5, 1981) vol. 2, pp. 675–692, Ed. H. M. Ortner.

Schleinkofer, U., et al., "Fatigue of Cutting Tool Materials," Proceedings of the Sixth International Fatigue Congress, 1996, Berlin, Germany, pp. 1639–1644, "Fatigue '96,'" vol. III, Ed. Lütjering & Nowack.

Schleinkofer, U. et al., "Fatigue of Hard Metals and Cermets," Materials Science and Engineering A209 (1996), pp. 313–317.

Schleinkofer, U. et al., "Microstructural Processes During Subcritical Crack Growth in Hard Metals and Cermets under Cyclic Loads," Materials Science and Engineering A209 (1996), pp. 103–110.

Schleinkofer, U., "Fatigue of Hard Metals and Cermets Under Cyclically Varying Stress," (German Language and English Translation), Thesis submitted to the Technical Faculty of the University of Erlangen–Nürnberg, 1995, pp. 11–12, 96–100, 199–203, & 207.

Schleinkofer, U. et al., "Fatigue of Hard Metals and Cermets—New Results and a Better Understanding," Int'l J. of Refractory Metals & Hard Materials 15 (1997), pp. 103–112.

Schleinkofer, U. et al., "Fatigue of Hard Metals and Cermets—The Present Knowledge and its Technical Importance and Application," Proceedings of the 1996 World Congress on Powder Metallurgy & Particular Materials, pp. 18–85 to 18–96, reprinted from Advances in Powder Metallurgy & Particulate Materials—1996.

Brookes, K. J. A., "World Directory and Handbook of Hardmetals and Hard Materials," Sixth Edition, International Carbide Data, pp. D15, D19, D31, D38, D44, D63, D78, D79, D82, D87, D96, D143, D175, D182, D223, D234, D237A.

Moskowitz, D. et al., "High–Strength Tungsten Carbides," International Journal of Powder Metallurgy 6(4) 1970, pp. 55–64.

Prakash, L. J., "The Influence of Carbide Grain Size and Binder Composition on the Properties of Cemented Carbides," Horizons in Powder Metallurgy (Proc. Of the 1986 International PM Conf. And Exhibition, Dusseldorf, Jul. 7–11, 1986) Part 1, pp. 261–264 (1986).

Prakash, L. et al., "The Influence of the Binder Composition on the Properties of WC–Fe/Co/Ni Cemented Carbides," Mod. Dev. Powder Metall. (1981), 14, pp. 255–68.

Roebuck, B., "Magnetic Moment (Saturation) Measurements on Hardmetals," National Physical Laboratory, Dec. 1994, DMM(A)146, pp. 1–12.

Guilemany, J. M., et al., "Mechanical–Property Relationships of Co/WC and Co–Ni–Fe/WC Hard Metal Alloys," International Journal of Refractory Metals and Hard Materials 12 (1993–1994), pp. 199–206.

Gabriel, A., et al., "New Experimental Data in the C Fe–W,–Co/W, C–Ni–W, C–Fe–Ni–W and C–Co–Ni–W Systems Application to Sintering Conditions of Cemented Carbides Optimization of Steel Binder Composition by Partial Factorial Experiments," Int. Inst. of the Science of Sintering Conf. held at Herceg–Novi, Yugoslavia (Sep. 1985), pp. 379–393, published by Plenum Press.

Gabriel, A. et al., "New Experimental Data in the C–Co–W, C–Fe–W, C–Ni–W C–Fe/Ni–W And C–Co/Ni–W Systems and Their Applications to Sintering Conditions," 11$^{th}$ International Plansee Seminar '85, (May 20–24, 1985, Reutte, Tirol, Austria), vol. 2, pp. 509–525, Ed. H. Bildstein & H. M. Ortner.

Mankins, W. L., et al., "Nickel and Nickel Alloys," Metals Handbook, Tenth Edition, vol. 2, Properties and Selection: Nonferrous Alloys and Special–Purpose Materials (1990), pp. 428–445, ASM International.

Uhrenius, B., et al., "On the Composition of Fe–Ni–Co–Wc–Based Cemented Carbides," International Journal Of Refractory Metals And Hard Materials 15 (1997), pp. 139–149.

Schubert, W–D., et al., "Phase Equilibria in the Systems Co–Mo–W–C and Ni–Mo–W–C," Translated from German, High Temperatures—High Pressures, 1982, Vo. 14, pp. 87–100.

Raynor, G. V., et al., "Phase Equilibria in Iron and Ternary Alloys, A Critical Assessment of the Experimental Literature," The Institute of Metals, 1988, pp. 7, 15, 16, 27–34, 71–80, 140–142, and 213–288.

Prakash, L., "Properties of Tungsten Carbides with an Iron–Cobalt–Nickel Binder in Sintered and Heat–Treated States" (German Language and English Translation), KFK–Nachr. (1979), 11(2), pp. 35–42, Inst. Mater.–Festoerperforsch., Karlsruhe, Germany.

Sundman B., et al., "The Thermo–Calc Databank System," Calphad, vol. 9, No. 2, 1985, pp. 153–190.

Doi, A. et al., "Thermodynamic Evaluation of Equilibrium Nitrogen Pressure and WC Separation in Ti–W–C–N System Carbonitride," 11$^{th}$ International Plansee Seminar '85 (May 20–24, 1985, Reutte, Tirol, Austria), vol. 1, pp. 825–843, Ed. H. Bildstein & H. M. Ortner.

Gustafson, P., "Thermodynamic Evaluation of C—W System," Materials Science and Technology, Jul. 1986, vol. 2, pp. 653–658.

Prakash, L. J., "Weiterentwicklung von Wolframcarbid Hartmetallen unter Verwendung von Eisen–Basis–Bindelegierungen [Development of Tungsten Carbide Hardmetals Using Iron–Based Binder Alloys]," KfK 2984, Institute for Materials and Solid States Research by Kernforschungszentrum in Karlsruhe, Germany, 1980, pp. 1–221(German Language).

Ramqvist, L., "Wetting of Metallic Carbides by Liquid Copper, Nickel, Cobalt and Iron," International Journal of Powder Metallurgy 1 (4), 1965, pp. 2–21.

Warren, R., "The Wetting of the Mixed Carbide, 50 w/o WC/50 w/o TiC by Cobalt, Nickel and Iron and Some of Their Alloys," International Journal of Powder Metallurgy 4 (1), 1968, pp. 51–60.

Yin Zhimin et al., "Microstructure and Properties of WC–10 (Fe,Co,Ni) Cemented Carbides," J. Cent.–South Inst. Min. Metall., vol. 25, No. 6, Dec. 1994, pp. 719–722.

Zhang Li, et al, "A New Hardmetal for Mining with Ni–Co Binder," Int. J. of Refractory Metals & Hard Materials 14 (1996), pp. 245–248.

ELONGATE ROTARY TOOL COMPRISING A CERMET HAVING A CO-NI-FE BINDER

BACKGROUND

The present invention pertains to an elongate rotary tool such as, for example, a drill, an endmill, a tap, a burr, a countersink, a hob, or a reamer, comprising at one end a shank adopted to be secured (e.g., by a chuck) to a machine tool and at another end a elongated body, which is optionally fluted. The elongated body may be comprised of multiple cutting edges, such as for example, a first cutting edge at the juncture of a first flank and a face, which optionally defines and transitions to at least a portion of a flute, and a second cutting edge at the juncture of a second flank and the face, which transitions from the first cutting edge at a common corner. The elongate rotary tool is for the machining of workpiece materials. For example and in the case of a drill, such an elongate rotary tool has been typically used to drill both through and blind holes in workpiece materials. For example and in the case of an end mill, such an elongate rotary tool has been typically used to mill workpiece materials.

For the most part when made from a cermet, elongate rotary tools are comprised of tungsten carbide cermets (WC-cermets), also known as cobalt cemented tungsten carbide or WC—Co . Here, a cobalt binder (Co-binder) cements tungsten carbide particles together. Although WC-cermets have achieved successful results as elongate rotary tools, there are some drawbacks.

One drawback is that up to about 45 percent of the world's primary cobalt production is located in politically unstable regions (e.g., political regions that have experienced either armed or peaceful revolutions in the past decade and could still experience additional revolutions). About 15 percent of the world's annual primary cobalt market is used in the manufacture of hard materials including WC-cermets. About 26 percent of the world's annual primary cobalt market is used in the manufacture of superalloys developed for advanced aircraft turbine engines—a factor contributing to cobalt being designated a strategic material. These factors not only contribute to the high cost of cobalt but also explain cobalt's erratic cost fluctuations. Consequently, cobalt has been relatively expensive, which, in turn, has raised the cost of WC-cermet elongate rotary tools. Such an increase in the cost of elongate rotary tools has been an undesirable consequence of the use of a Co-binder for elongate rotary tools. Therefore, it would be desirable to reduce cobalt from the binder of cermets.

Furthermore, because of the principal locations of the largest cobalt reserves, there remains the potential that the supply of cobalt could be interrupted due to any one of a number of causes. The unavailability of cobalt would, of course, be an undesirable occurrence.

Elongate rotary tools may operate in environments that are corrosive. While WC-cermets having a Co-binder have been adequate in such corrosive environments, the development of elongate rotary tools that have improved corrosion resistance without losing any of the machining performance remains an objective.

While the use of WC-cermets having a Co-binder for elongate rotary tools has been successful, there remains a need to provide an elongate rotary tool that does not have the drawbacks, i.e., cost and the potential for unavailability, inherent with the use of cobalt set forth above. There also remains a need to develop an elongate rotary tool for use in corrosive environments that possess improved corrosion resistance without losing any of the cutting performance characteristics of WC-cermets having a Co-binder.

SUMMARY

An improved cermet comprising a cobalt-nickel-iron binder (Co—Ni—Fe-binder) having unexpected mechanical and physical properties over the prior art has been discovered. The discovery is surprising in that the Co—Ni—Fe-binder comprises a composition that is contrary to the teaching of the prior art. More particularly, the inventive cermet for elongate rotary tools comprises about 0.2 weight percent (wt. %) to about 19 wt. % Co—Ni—Fe-binder (a more typical range comprises about 5 wt. % to about 16 wt. % and a narrower typical range comprises about 8 wt. % to about 12 wt. %) and about 81 wt. % to about 99.8 wt. % hard component. The hard component comprises at least one of borides, carbides, nitrides, oxides, suicides, their mixtures, their solid solutions, and combinations of the preceding. Preferably, the hard component comprises at least one of carbides and carbonitrides, for example, such as tungsten carbide and/or titanium carbonitride optionally with other carbides (e.g., TaC, NbC, TiC, VC, $Mo_2C$, $Cr_3C_2$) present as simple carbides and/or in solid solution.

Elongate rotary tools for the machining of materials, such as woods, metals, polymers, ceramics, and composites comprising one or more of metals, polymers, and ceramics, are composed of the foregoing compositions. The elongate rotary tools in accordance with the present invention comprise a face and, optionally, a flute over which chips, formed during machining, flow. At a juncture of the face and a first flank, a first cutting edge is formed while at the juncture of the face and a second flank, a second cutting edge is formed. The first and second cutting edges are for cutting into a workpiece material as the elongate body of the tool is in rotational contact with the workpiece material. Depending upon the type of elongate rotary tool (e.g., drill vs. endmill) the first cutting edge may perform the majority of the material machining while the second cutting edge performs material machining to a lesser extent and visa-a-versa.

The invention illustratively disclosed herein may suitably be practiced in the absence of any element, step, component, or ingredient which is not specifically disclosed herein.

BRIEF DESCRIPTION OF THE DRAWINGS

These and other features, aspects, and advantages of the present invention will become better understood with reference to the following description, appended claims, and accompanying drawings where:

DESCRIPTION

In accordance with the present invention, FIGS. 1, 2, 3, and 4 show embodiments of elongate rotary tools composed of a cermet having a Co—Ni—Fe-binder. The elongate rotary tools may be used in the machining (e.g. drilling, milling, reaming, and tapping) of workpiece materials including woods, metals, polymers, ceramics, and composites thereof. This invention is preferably used in the machining of metallic workpiece materials, and are particularly useful in drilling and/or milling of these workpiece materials where a combination of high toughness and high wear resistance is required.

Figure 1:
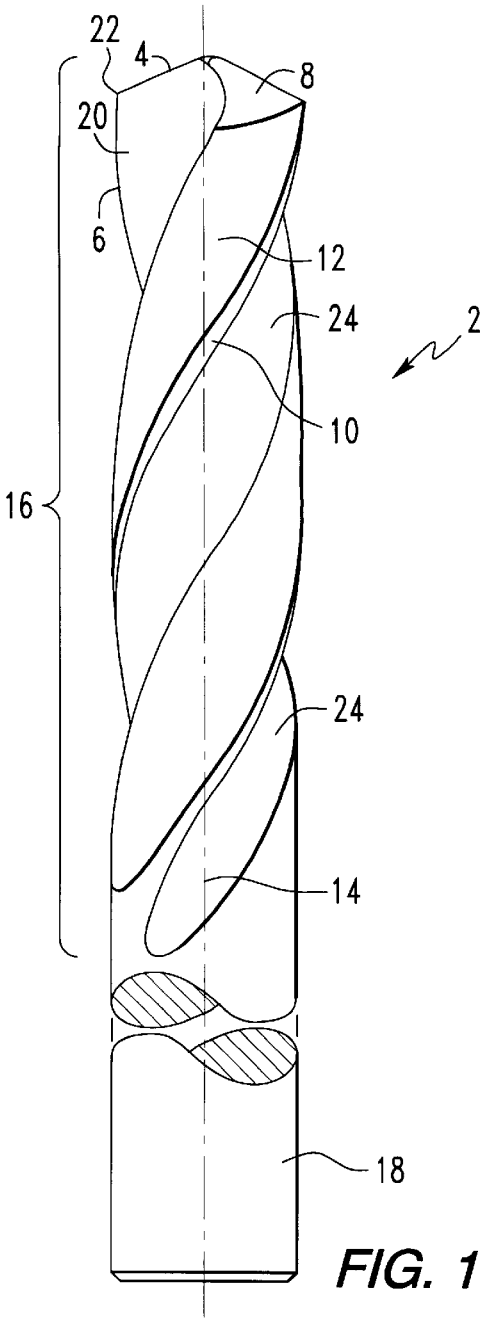
FIG. 1 is a side view of a drill, a particular embodiment of an elongate rotary tool.
Figure 2:
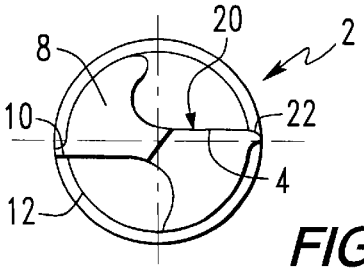
FIG. 2 is a top view of the drill of FIG. 1.

As shown in FIGS. 1 and 2, when the elongate rotary tool comprises a drill 2, it has at one end an elongate body 16 and at a second end a shank 18. The elongate body 16 and the shank 18 share a common axis 14. The shank 18 is adapted to be secured, e.g., in a chuck, in a machine tool. The elongate body 16 has a face 20 over which chips, formed during drilling of workpiece materials, flow. The face 20 may define or transition into a groove or flute 24 for transporting chips away from the cut surface of the workpiece material. Joined to the face 20 are first flank 8 and second flank 10. At the juncture of the face 20 and the first flank 8 is a first cutting edge 4 for cutting into workpiece materials. At the juncture of the face 20 and the second flank 10 is a second cutting edge 6 also for cutting into workpiece materials. Second flank 10 optionally may be followed by a recessed surface 12. The first cutting edge 4 transitions to the second cutting edge 6 at a corner 22. The second cutting edge 6 may take the form of a helix and continue for a preselected distance along the length of the elongate body 16. In the case of a drill, first cutting edge 4 performs a majority of the cutting into the workpiece materials.

Figure 3:
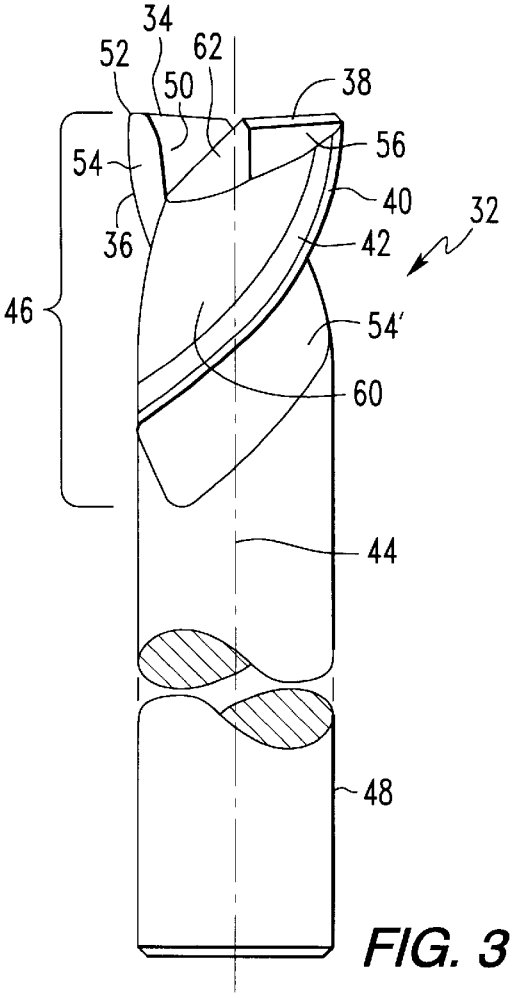
FIG. 3 is a side view of an endmill, a particular embodiment of an elongate rotary tool.
Figure 4:
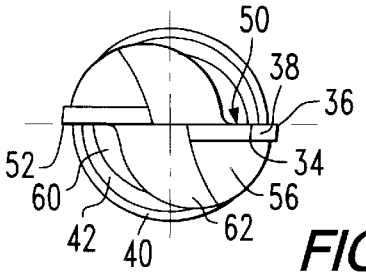
FIG. 4 is a top view of the endmill of FIG. 3.

As shown in FIGS. 3 and 4, when the elongate rotary tool comprises an endmill 32, it has at one end an elongate body 46 and at a second end a shank 48. The elongate body 46 and the shank 48 share a common axis 44. The shank 48 is adapted to be secured, e.g., in a chuck, in a machine tool. The elongate body 46 has a face 50 over which chips, formed during milling of workpiece materials, flow. The face 50 may define or transition into a groove or flute 54 and 54' for transporting chips away from the cut surface of workpiece materials. Joined to the face 50 are first flank 38 and second flank 40. At the juncture of the face 50 and the first flank 38 is a first cutting edge 34 for cutting into workpiece materials. First flank 38 optionally may be followed by additional recessed surfaces 56 and 62. At the juncture of the face 50 and/or the groove or flute 54 and the second flank 40 is a second cutting edge 36 also for cutting into workpiece materials. Second flank 40 optionally may be followed by recessed surfaces 42 and 60. The first cutting edge 34 transitions to the second cutting edge 36 at a corner 52. The second cutting edge 36 may take the form of a helix and continue for a preselected distance along the length of the elongate body 46. In the case of an endmill 32, either the first cutting edge 34 and/or the second cutting edge 36 may perform a majority of the cutting into workpiece materials.

The elongate rotary tool may be any of the style or sizes of drills, endmills, taps, burs, countersinks, hobs, and reamers used in the industry. For example, if the elongate rotary tool comprises a drill, it may be made in standard shapes and sizes (for example, two-fluted style of drill without or with coolant channels). The typical types of workpiece materials that a two-fluted coolant channel style of drill cuts includes carbon, alloy and cast steel, high alloy steel, malleable cast iron, gray cast iron, nodular iron, yellow brass and copper alloys.

It should also be appreciated that various styles of drills and endmills are within the scope of this invention. In this regard, other styles of drills include without limitation a triple fluted style of drill and a two-fluted style of drill that does or does not have coolant channels. The triple fluted style of drill typically cuts gray cast iron, nodular iron, titanium and its alloys, copper alloys, magnesium alloys, wrought aluminum alloys, aluminum alloys with greater than 10 wt. % silicon, and aluminum alloys with less than 10 wt. % silicon. The two fluted without coolant channels style of drill typically cuts carbon steel, alloy and cast steel, high alloy steel, malleable cast iron, gray cast iron, nodular iron, yellow brass and copper alloys. In addition to the metallic materials mentioned above, the drills, end mills, hobs, and reamers may be used to cut other metallic materials, polymeric materials, and ceramic materials including without limitation combinations thereof (e.g., laminates, macrocomposites and the like), and composites thereof such as, for example, metal-matrix composites, polymer-matrix composites, and ceramic-matrix composites.

The cermet from which the elongate rotary tool of FIGS. 1, 2, 3, and 4 is made comprises a Co—Ni—Fe-binder and at least one hard component. The Co—Ni—Fe-binder is unique in that even when subjected to plastic deformation, the binder maintains its face centered cubic (fcc) crystal structure and avoids stress and/or strain induced transformations. Applicants have measured strength and fatigue performance in cermets having Co—Ni—Fe-binders up to as much as about 2400 megapascal (MPa) for bending strength and up to as much as about 1550 MPa for cyclic fatigue (200,000 cycles in bending at about room temperature). Applicants believe that substantially no stress and/or strain induced phase transformations occur in the Co—Ni—Fe-binder up to those stress and/or strain levels that leads to superior performance.

Applicants believe that in the broadest sense the Co—Ni—Fe-binder comprises at least about 40 wt. % cobalt but not more than 90 wt. % cobalt, at least about 4 wt. % nickel, and at least about 4 wt. % iron. Applicant believes that the Co—Ni—Fe-binder comprising not more than about 36 wt. % Ni and not more than about 36 wt. % Fe is preferred. A preferred Co—Ni—Fe-binder comprises about 40 wt. % to about 90 wt. % Co, about 4 wt. % to about 36 wt. % Ni, about 4 wt. % to about 36 wt. % Fe, and a Ni:Fe ratio of about 1.5:1 to 1:1.5. A more preferred Co—Ni—Fe-binder comprises about 40 wt. % to about 90 wt. % Co and a Ni:Fe ratio of about 1:1. An other more preferred Co—Ni—Fe-binder comprises a cobalt:nickel:iron ratio of about 1.8:1:1.

It will be appreciated by those skilled in the art that the Co—Ni—Fe-binder may also comprise at least one secondary alloying element either in place of one or both of nickel and iron and/or in a solid solution with the Co—Ni—Fe-binder and/or as discrete precipitates in the Co—Ni—Fe-binder. Such at least one secondary alloying element may contribute the physical and/or mechanical properties of the cermet. Whether or not the at least one secondary alloying element contributes to the properties of the cermet, the least one secondary alloying element may be included in the Co—Ni—Fe-binder to the extent that the least one secondary alloying element does not detract from the properties and/or performance of the elongate rotary tool.

The range of the Co—Ni—Fe-binder in the cermet comprises about 0.2 wt. % to about 19 wt. %. A preferred range of the Co—Ni—Fe-binder in the cermet comprises, about 5 wt. % to about 16 wt. %. A more preferred range of Co—Ni—Fe-binder in the cermet comprises, about 8 wt. % to about 12 wt. %.

The hard component of the cermet of the present invention may comprise borides(s), carbide(s), nitride(s), oxide (s), silicide(s), their mixtures, their solid solutions (e.g., carbonitride(s), borocarbide(s), oxynitride(s), borocarbonitride(s) . . . etc.), or any combination of the preceding. The metal of these may comprise one or more metals from International Union of Pure and Applied Chemistry (IUPAC) groups 2, 3 (including lanthanides and actinides), 4, 5, 6, 7, 8, 9, 10, 11, 12, 13, and 14 of the Periodic Table. Preferably the hard component comprises one or more of carbide(s), nitride(s), carbonitride(s), their mixture(s), their solid solution(s), or any combination of the preceding. The metal of the carbide(s), nitride(s), and carbonitrides(s) may comprise one or more metal from IUPAC groups 3 (including lanthanides and actinides), 4, 5, and 6; preferably, one or more of Ti, Zr, Hf, V, Nb, Ta, Cr, Mo, and W; and more preferably one or more of Ti, Ta, Nb, and W.

In this context, the inventive cermets may be referred to by the composition making up a majority of the hard component. For example, if a majority of the hard component comprises a carbide, the cermet may be designated a carbide-cermet. If a majority of the hard component comprises tungsten carbide (WC), the cermet may be designated a tungsten carbide cermet or WC-cermet. In a like manner, when a majority of the hard component comprises a carbonitride, the cermet may also be designated a carbonitride-cermet. For example, when a majority of the hard component comprises titanium carbonitride, the cermet may be designated a titanium carbonitride-cermet or TiCN-cermet.

A broadest range for the grain size of the hard component comprises about 0.1 micrometers ($\mu$m) to 12 $\mu$m. A mediate range for the grain size of the hard component comprises about 8 $\mu$m and smaller. Another mediate range for the grain size of the hard component comprises about 6 $\mu$m and smaller. A narrower range for the grain size of the hard component comprises about 1 $\mu$m and smaller. Applicants believe that the above ranges of hard component grain size are particularly applicable to WC-cermets having a Co—Ni—Fe-binder.

Applicants contemplate that every increment between the endpoints of ranges disclosed herein, for example, binder content, binder composition, Ni:Fe ratio, hard component grain size, hard component content, . . . etc. is encompassed herein as if it were specifically stated. For example, a binder content range of about 0.2 wt. % to 19 wt. % encompasses about 1 wt. % increments thereby specifically including about 0.2 wt. %, 1 wt. %, 2 wt. %, 3 wt. %, . . . 17 wt. %, 18 wt. % and 19 wt. % binder. While for example, for a binder composition the cobalt content range of about 40 wt. % to 90 wt. % encompasses about 1 wt. % increments thereby specifically including 40 wt. %, 41 wt. %, 42 wt. %, . . . 88 wt. %, 89 wt. %, and 90 wt. % while the nickel and iron content ranges of about 4 wt. % to 36 wt. % each encompass about 1 wt. % increments thereby specifically including 4 wt. %, 5 wt. %, 6 wt. %, . . . 34 wt. %, 35 wt. %, and 36 wt. %. Further for example, a Ni:Fe ratio range of about 1.5:1 to 1:1.5 encompasses about 0.1 increments thereby specifically including 1.5:1, 1.4:1, . . . 1:1, . . . 1:1.4, and 1:1.5). Furthermore for example, a hard component grain size range of about 0.1 $\mu$m to about 12 $\mu$m encompasses about 1 $\mu$m increments thereby specifically including about 0.1 $\mu$m, 1 $\mu$m, 2 $\mu$m, 3 $\mu$m, . . . 10 $\mu$m, 11 $\mu$m, and 12 $\mu$m.

A cermet elongate rotary tool of the present invention may be used either with or without a coating. If the elongate rotary tool is to be used with a coating, then the elongate rotary tool is coated with a coating that exhibits suitable properties such as, for example, lubricity, wear resistance, satisfactory adherence to the cermet, chemical inertness with workpiece materials at material removal temperatures, and a coefficient of thermal expansion that is compatible with that of the cermet (i.e., compatible thermo-physical properties). The coating may be applied via CVD and/or PVD techniques.

Examples of the coating material, which may comprise one or more layers of one or more different components, may be selected from the following, which is not intended to be all-inclusive: alumina, zirconia, aluminum oxynitride, silicon oxynitride, SiAlON, the borides of the elements for IUPAC groups 4, 5, and 6, the carbonitrides of the elements from IUPAC groups 4, 5, and 6, including titanium carbonitride, the nitrides of the elements from IUPAC groups 4, 5, and 6 including titanium nitride, the carbides of the elements from IUPAC groups 4, 5, and 6 including titanium carbide, cubic boron nitride, silicon nitride, carbon nitride, aluminum nitride, diamond, diamond like carbon, and titanium aluminum nitride.

The significant advantages of the present invention are further indicated by the following examples which are intended to be purely illustrative of the present invention.

As summarized in Table 1, a WC-cermet having a Co—Ni—Fe-binder of this invention and a comparative conventional WC-cermet having a Co-binder were produced using conventional powder technology as described in, for example, "World Directory and Handbook of HARDMETALS AND HARD MATERIALS" Sixth Edition, by Kenneth J. A. Brookes, International Carbide DATA (1996); "PRINCIPLES OF TUNGSTEN CARBIDE ENGINEERING" Second Edition, by George Schneider, Society of Carbide and Tool Engineers (1989); "Cermet-Handbook", Hertel AG, Werkzeuge+Hartstoffe, Fuerth, Bavaria, Germany (1993); and "CEMENTED CARBIDES", by P. Schwarzkopf & R. Kieffer, The Macmillan Company (1960)—the subject matter of which is herein incorporated by reference in it entirety. In particular, Table 1 presents a summary of the nominal binder content in weight percent (wt. %), the nominal binder composition, and the hard constituent composition and amount (wt. %) for a cermet of this invention and a comparative prior art WC-cermet having a Co-binder. That is, commercially available ingredients are obtained for each of the inventive and the conventional composition as described in Table 1 and combined in independent attritor mills with hexane for homogeneous blending over a period of about 12 hours. After each homogeneously blended mixture of ingredients is appropriately dried, green bodies are pressed. The green bodies are densified by pressure-sintering (also known as sinter-HIP) at about 1420° C. for about 1.5 hours (during the last 10 minutes at about 1420° C. the furnace pressure is raised to about 4 MPa).

TABLE 1

Nominal Composition for Invention & Comparative Conventional WC-Cermet

| | Nominal Binder Content | Nominal Binder Composition (wt. %) | | | Hard Component Composition and amount (wt. %) | | |
|---|---|---|---|---|---|---|---|
| Sample | (wt. %) | Co | Ni | Fe | TiCN | Ta(Nb)C | WC |
| Invention | 11.0 | 5.4 | 2.8 | 2.8 | 4 | 8 | 77 |
| Conventional | 11.0 | 11 | 0.0 | 0.0 | 4 | 8 | 77 |

As summarized in Table 2, a TiCN-cermet having a Co—Ni—Fe-binder of this invention and a comparative conventional TiCN-cermet having a Co-binder are produced using conventional powder technology as described in, for example, "World Directory and Handbook of HARDMETALS AND HARD MATERIALS"; "PRINCIPLES OF TUNGSTEN CARBIDE ENGINEERING" Second Edition; and "CEMENTED CARBIDES". In particular, Table 2 presents a summary of the nominal binder content in weight percent (wt. %), the nominal binder composition, and the hard constituent composition and amount (wt. %) for a cermet of this invention and a comparative prior art TiCN-cermet having a Co-binder. That is, commercially available ingredients are obtained for each of the inventive and the conventional composition as described in Table 2 and combined in independent attritor mills with hexane for homogeneous blending over a period of about 14 hours. After each homogeneously blended mixture of ingredients is appropriately dried, green bodies are pressed. The green bodies are densified by pressure-sintering (also known as sinter-HIP) at about 1440° C. for about 1.5 hours (during the last 10 minutes at about 1440° C. the furnace pressure is raised to about 4 MPa).

TABLE 2

Nominal Composition for Invention & Comparative Conventional TiCN-Cermet

| | Nominal Binder | Nominal Binder Composition | | | Hard Component Composition and amount (wt. %) | | |
|---|---|---|---|---|---|---|---|
| | Content | (wt. %) | | | | | WC + |
| Sample | (wt. %) | Co | Ni | Fe | TiCN | Ta(Nb)C | $Mo_2C$ |
| Invention | 16 | 7.6 | 4.2 | 4.2 | 43 | 14 | 27 |
| Conventional | 16 | 10 | 6.0 | 0.0 | 43 | 14 | 27 |

The patents and other documents identified herein, including United States patent application Ser. No. 08/918,993 entitled "A CERMET HAVING A BINDER WITH IMPROVED PLASTICITY" by Hans-Wilm Heinrich, Manfred Wolf, Dieter Schmidt, and Uwe Schleinkofer (the applicants of the present patent application) which was filed on the same date as the present patent application and assigned to Kennametal Inc. (the same assignee as the assignee of the present patent application), are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. An elongate rotary tool for machining materials, the rotary tool comprising:

an elongate body at a first end;

a shank at a second and opposite end, the elongate body and the shank sharing a common axis;

at least one face on the elongate body at an end opposite the shank, wherein the at least one face defines a corresponding flute extending along the elongate body toward the shank;

at least one flank on an end of the elongate body at an end opposite the shank; and a cutting edge at a juncture of the at least one face and the at least one flank, wherein the at least one flank, the at least one face, and the cutting edge at the juncture thereof of the elongate rotary tool comprise a cermet comprising at least one hard component and about 0.2 wt. % to about 19 wt. % Co—Ni—Fe-binder comprising about 40 wt. % to about 90 wt. % cobalt, about 4 wt. % to about 36 wt. % nickel, about 4 wt. % to about 36 wt. % iron, and a cobalt:nickel:iron ratio comprising about 1.8:1:1.

2. The elongate rotary tool of claim 1 wherein the cermet comprises about 5 wt. % to about 16 wt. % Co—Ni—Fe-binder.

3. The elongate rotary tool of claim 1 wherein the cermet comprises about 8 wt. % to about 12 wt. % Co—Ni—Fe-binder.

4. The elongate rotary tool of claim 1 wherein the Co—Ni—Fe-binder comprises a face centered cubic (fcc) structure that substantially maintains its fcc structure when subjected to plastic deformation thereby exhibiting substantially no stress and strain induced phase transformations.

5. The elongate rotary tool of claim 1 wherein the Co—Ni—Fe-binder comprises a face centered cubic (fcc) structure that substantially maintains its fcc structure when the cermet is subjected to a bending strength test under up to as much as about 2400 megapascal (MPa).

6. The elongate rotary tool of claim 1 wherein the Co—Ni—Fe-binder comprises a face centered cubic (fcc) structure that substantially maintains its fcc structure when the cermet is subjected to up to about 200,000 cycles at up to about 1550 megapascal (MPa) in a cyclic fatigue test in bending at about room.

7. The elongate rotary tool of claim 1 comprising a drill, an endmill, a tap, a burr, a countersink, a hob, or a reamer.

8. The elongate rotary tool of claim 1 wherein the at least one hard component has a grain size comprising about 0.1 micrometer ($\mu$m) to about 12 $\mu$m.

9. The elongate rotary tool of claim 1 wherein the at least one hard component has a grain size comprising about 6 $\mu$m and smaller.

10. The elongate rotary tool of claim 1 wherein the at least one hard component has a grain size comprising about 1 $\mu$m and smaller.

11. The elongate rotary tool of claim 1 wherein the cermet comprises a carbide-cermet.

12. The elongate rotary tool of claim 1 wherein the cermet comprises a carbonitride-cermet.

13. An elongate rotary tool for machining materials, the rotary tool comprising:

an elongate body at a first end;

a shank at a second and opposite end, the elongate body and the shank sharing a common axis;

at least one face on the elongate body at an end opposite the shank, wherein the at least one face defines a corresponding flute extending along the elongate body toward the shank;

at least one flank on an end of the elongate body at an end opposite the shank; and a cutting edge at a juncture of the at least one face and the at least one flank, wherein the at least one flank, the at least one face, and the cutting edge at the juncture thereof of the elongate rotary tool comprise a WC-cermet comprising tungsten carbide and about 0.2 wt. % to about 19 wt. % Co—Ni—Fe-binder comprising about 40 wt. % to about 90 wt. % cobalt, about 4 wt. % to about 36 wt. % nickel, about 4 wt. % to about 36 wt. % iron, and a cobalt:nickel:iron ratio comprising about 1.8:1:1.

14. The elongate rotary tool of claim 13 wherein the WC-cermet comprises about 5 wt. % to about 16 wt. % Co—Ni—Fe-binder.

15. The elongate rotary tool of claim 13 wherein the WC-cermet comprises about 8 wt. % to about 12 wt. % Co—Ni—Fe-binder.

16. The elongate rotary tool of claim 13 wherein the Co—Ni—Fe-binder comprises a face centered cubic (fcc)

structure that substantially maintains its fcc structure when subjected to plastic deformation thereby exhibiting substantially no stress and strain induced phase transformations.

17. The elongate rotary tool of claim 13 wherein the Co—Ni—Fe-binder comprises a face centered cubic (fcc) structure that substantially maintains its fcc structure when the cermet is subjected to a bending strength test under up to as much as about 2400 megapascal (MPa).

18. The elongate rotary tool of claim 13 wherein the Co—Ni—Fe-binder comprises a face centered cubic (fcc) structure that substantially maintains its fcc structure when the cermet is subjected to up to about 200,000 cycles at up to about 1550 megapascal (MPa) in a cyclic fatigue test in bending at about room.

19. The elongate rotary tool of claim 13 comprising a drill, an endmill, a tap, a burr, a countersink, a hob, or a reamer.

20. The elongate rotary tool of claim 13 wherein the tungsten carbide has a grain size comprising about 0.1 $\mu$m to about 12 $\mu$m.

21. The elongate rotary tool of claim 13 wherein the tungsten carbide has a grain size comprising about 6 $\mu$m and smaller.

22. The elongate rotary tool of claim 13 wherein the tungsten carbide has a grain size comprising about 1 $\mu$m and smaller.

23. The elongate rotary tool of claim 13 wherein the WC-cermet further comprises at least one of carbides, nitrides, and solid solution thereof.

24. The elongate rotary tool of claim 13 wherein the WC-cermet further comprises at least one of TaC, NbC, TiC, VC, $Mo_2C$, $Cr_3C_2$, and solid solution thereof.

25. An elongate rotary tool for machining materials, the rotary tool comprising:

an elongate body at a first end;

a shank at a second and opposite end, the elongate body and the shank sharing a common axis;

at least one face on the elongate body at an end opposite the shank, wherein the at least one face defines a corresponding flute extending along the elongate body toward the shank;

at least one flank on an end of the elongate body at an end opposite the shank; and a cutting edge at a juncture of the at least one face and the at least one flank, wherein the at least one flank, the at least one face, and the cutting edge at the juncture thereof of the elongate rotary tool comprise a TiCN-cermet comprising titanium carbonitride and about 0.2 wt. % to about 19 wt. % Co—Ni—Fe-binder comprising about 40 wt. % to about 90 wt. % cobalt, about 4 wt. % to about 36 wt. % nickel, about 4 wt. % to about 36 wt. % iron, and a cobalt:nickel:iron ratio comprising about 1.8:1:1.

26. The elongate rotary tool of claim 25 wherein the TiCN-cermet comprises about 5 wt. % to about 16 wt. % Co—Ni—Fe-binder.

27. The elongate rotary tool of claim 25 wherein the TiCN-cermet comprises about 8 wt. % to about 12 wt. % Co—Ni—Fe-binder.

28. The elongate rotary tool of claim 25 wherein the Co—Ni—Fe-binder comprises a face centered cubic (fcc) structure that substantially maintains its fcc structure when subjected to plastic deformation thereby exhibiting substantially no stress and strain induced phase transformations.

29. The elongate rotary tool of claim 25 wherein the Co—Ni—Fe-binder comprises a face centered cubic (fcc) structure that substantially maintains its fcc structure when the cermet is subjected to a bending strength test under up to as much as about 2400 megapascal (MPa).

30. The elongate rotary tool of claim 25 wherein the Co—Ni—Fe-binder comprises a face centered cubic (fcc) structure that substantially maintains its fcc structure when the cermet is subjected to up to about 200,000 cycles at up to about 1550 megapascal (MPa) in a cyclic fatigue test in bending at about room temperature.

31. The elongate rotary tool of claim 25 comprising a drill, an endmill, a tap, a burr, a countersink, a hob, or a reamer.

32. The elongate rotary tool of claim 25 wherein the titanium carbonitride has a grain size comprising about 0.1 $\mu$m to about 12 $\mu$m.

33. The elongate rotary tool of claim 25 wherein the titanium carbonitride has a grain size comprising about 6 $\mu$m and smaller.

34. The elongate rotary tool of claim 25 wherein the titanium carbonitride has a grain size comprising about 1 $\mu$m and smaller.

35. The elongate rotary tool of claim 25 wherein the TiCN-cermet further comprises at least one of carbides, nitrides, and solid solution thereof.

36. The elongate rotary tool of claim 25 wherein the TiCN-cermet further comprises at least one of TaC, NbC, TiC, VC, $Mo_2C$, $Cr_3C_2$, WC, and solid solution thereof.

37. The elongate rotary tool of claim 13 wherein the WC-cermet further comprises at least one of a nitride and a solid solution of a carbide and nitride.

38. The elongate rotary tool of claim 13 wherein the WC-cermet has a tungsten carbide grain size comprising about 8 $\mu$m or smaller.

39. The elongate rotary tool of claim 25 wherein the TiCN-cermet further comprises at least one of a carbide and a solid solution of a nitride and a carbide.

40. The elongate rotary tool of claim 39 wherein the TiCN-cermet wherein the at least one carbide comprises at least one of TaC, NbC, TiC, VC, $Mo_2C$, $Cr_3C_2$, WC, and solid solution thereof.

41. The elongate rotary tool of claim 25 wherein the TiCN-cermet has a titanium carbonitride grain size comprising about 8 $\mu$m or smaller.

42. The elongate rotary tool of claim 13 further comprising a coating on at least a portion of the WC-cermet.

43. The elongate rotary tool of claim 42 wherein the coating comprises one or more layers.

44. The elongate rotary tool of claim 43 wherein the one or more layers comprise one or more different components.

45. The elongate rotary tool of claim 43 wherein the one or more layers comprise one or more of borides, carbides, carbonitrides and nitrides of the elements from International Union of Pure and Applied Chemistry (IUPAC) groups 4, 5, and 6.

46. The elongate rotary tool of claim 43 wherein the one or more layers comprise one or more of alumina, zirconia, aluminum oxynitride, silicon oxynitride, SiAlON, titanium carbonitride, titanium carbide, cubic boron nitride, silicon nitride, carbon nitride, aluminum nitride, diamond, diamond like carbon, and titanium aluminum nitride.

47. The elongate rotary tool of claim 43 wherein the one or more layers comprise a layer applied via a physical vapor deposition (PVD) technique.

48. The elongate rotary tool of claim 43 wherein the one or more layers comprise at least one layer applied via a chemical vapor deposition (CVD) technique.

49. The elongate rotary tool of claim 43 wherein the one or more layers comprise at least one component having the property of lubricity.

50. An elongate rotary tool for machining materials, the rotary tool comprising:

an elongate body at a first end;

a shank at a second and opposite end, the elongate body and the shank sharing a common axis;

at least one face on the elongate body at an end opposite the shank, wherein the at least one face defines a corresponding flute extending along the elongate body toward the shank;

at least one flank on an end of the elongate body at an end opposite the shank; and a cutting edge at a juncture of the at least one face and the at least one flank, wherein the at least one flank, the at least one face, and the cutting edge at the juncture thereof of the elongate rotary tool comprise a WC-cermet comprising tungsten carbide having a grain size comprising about 6 $\mu$m or smaller and about 0.2 wt. % to about 4 wt. % Co—Ni—Fe-binder comprising about 40 wt. % to about 90 wt. % cobalt, about 4 wt. % to about 36 wt. % nickel, about 4 wt. % to about 36 wt. % iron, and a Ni:Fe ratio of about 1.5:1 to about 1:1.5.

51. An elongate rotary tool for machining materials, the rotary tool comprising:

an elongate body at a first end;

a shank at a second and opposite end, the elongate body and the shank sharing a common axis;

at least one face on the elongate body at an end opposite the shank, wherein the at least one face defines a corresponding flute extending along the elongate body toward the shank;

at least one flank on an end of the elongate body at an end opposite the shank; and a cutting edge at a juncture of the at least one face and the at least one flank.

wherein the at least one flank, the at least one face, and the cutting edge at the juncture thereof of the elongate rotary tool comprise a WC-cermet comprising tungsten carbide having a grain size comprising about 6 $\mu$m or smaller and about 8 wt. % to about 9 wt. % Co—Ni—Fe-binder comprising about 40 wt. % to about 90 wt. % cobalt, about 4 wt. % to about 36 wt. % nickel, about 4 wt. % to about 36 wt. % iron, and a Ni:Fe ratio of about 1.5:1 to about 1:1.5.

52. An elongate rotary tool for machining materials, the rotary tool comprising:

an elongate body at a first end;

a shank at a second and opposite end, the elongate body and the shank sharing a common axis;

at least one face on the elongate body at an end opposite the shank, wherein the at least one face defines a corresponding flute extending along the elongate body toward the shank;

at least one flank on an end of the elongate body at an end opposite the shank; and a cutting edge at a juncture of the at least one face and the at least one flank, wherein the at least one flank, the at least one face, and the cutting edge at the juncture thereof of the elongate rotary tool comprise a cermet comprising at least one hard component and about 11 wt. % to about 19 wt. % Co—Ni—Fe-binder comprising about 40 wt. % to about 90 wt. % cobalt, about 4 wt. % to about 36 wt. % nickel, about 4 wt. % to about 36 wt. % iron, and a Ni:Fe ratio of about 1.5:1 to about 1:1.5.

53. The elongate rotary tool of claim 52 wherein the cermet comprises a carbide-cermet.

54. The elongate rotary tool of claim 53 wherein the carbide-cermet comprises a WC-cermet.

55. The elongate rotary tool of claim 54 wherein the WC-cermet further comprises at least one of nitrides and solid solution of carbides and nitrides.

56. The elongate rotary tool of claim 54 wherein the WC-cermet further comprises at least one of TaC, NbC, TiC, VC, $Mo_2C$, $Cr_3C_2$, WC, and solid solution thereof.

57. The elongate rotary tool of claim 54 wherein the WC-cermet comprises about 11 wt. % to about 16 wt. % Co—Ni—Fe-binder.

58. The elongate rotary tool of claim 54 wherein the WC-cermet has a tungsten carbide grain size comprising about 0.1 $\mu$m to about 12 $\mu$m.

59. The elongate rotary tool of claim 54 wherein the WC-cermet has a tungsten carbide grain size comprising about 1 $\mu$m or smaller.

60. The elongate rotary tool of claim 54 wherein the Co—Ni—Fe-binder comprises a face centered cubic (fcc) structure that substantially maintains its fcc structure when subjected to plastic deformation thereby exhibiting substantially no stress and strain induced phase transformations.

61. The elongate rotary tool of claim 54 wherein the Co—Ni—Fe-binder comprises a face centered cubic (fcc) structure that substantially maintains its fcc structure when the cermet is subjected to a bending strength test under up to as much as about 2400 megapascal (MPa).

62. The elongate rotary tool of claim 54 wherein the Co—Ni—Fe-binder comprises a face centered cubic (fcc) structure that substantially maintains its fcc structure when the cermet is subjected to up to about 200,000 cycles at up to about 1550 megapascal (MPa) in a cyclic fatigue test in bending at about room temperature.

63. The elongate rotary tool of claim 54 further comprising a coating on at least a portion of the WC-cermet.

64. The elongate rotary tool of claim 54 wherein the coating comprises one or more layers.

65. The elongate rotary tool of claim 64 wherein the one or more layers comprise one or more different components.

66. The elongate rotary tool of claim 64 wherein the one or more layers comprise one or more of borides, carbides, carbonitrides and nitrides of the elements from IUPAC groups 4, 5, and 6.

67. The elongate rotary tool of claim 64 wherein the one or more layers comprise one or more of alumina, zirconia, aluminum oxynitride, silicon oxynitride, SiAlON, titanium carbonitride, titanium carbide, cubic boron nitride, silicon nitride, carbon nitride, aluminum nitride, diamond, diamond like carbon, and titanium aluminum nitride.

68. The elongate rotary tool of claim 64 wherein the one or more layers comprise a layer applied via a physical vapor deposition (PVD) technique.

69. The elongate rotary tool of claim 64 wherein the one or more layers comprise at least one layer applied via a chemical vapor deposition (CVD) technique.

70. The elongate rotary tool of claim 64 wherein the one or more layers comprise at least one component having the property of lubricity.

* * * * *